US008686811B2

(12) United States Patent
Takei et al.

(10) Patent No.: US 8,686,811 B2
(45) Date of Patent: Apr. 1, 2014

(54) STRIPLINE FILTER

(75) Inventors: Yasunori Takei, Kyoto-Fu (JP); Tatsuya Tsujiguchi, Kyoto-Fu (JP); Motoharu Hiroshima, Kyoto-Fu (JP)

(73) Assignee: Murata Manufacturing Co., Ltd., Nagaokakyo-shi, Kyoto-Fu (JP)

( * ) Notice: Subject to any disclaimer, the term of this patent is extended or adjusted under 35 U.S.C. 154(b) by 0 days.

(21) Appl. No.: 13/299,626

(22) Filed: Nov. 18, 2011

(65) Prior Publication Data

US 2012/0062344 A1 Mar. 15, 2012

Related U.S. Application Data

(63) Continuation of application No. PCT/JP2010/055650, filed on Mar. 30, 2010.

(30) Foreign Application Priority Data

May 26, 2009 (JP) ..... 2009-126666

(51) Int. Cl.
*H01P 1/203* (2006.01)
*H01P 7/08* (2006.01)

(52) U.S. Cl.
USPC ..... 333/204; 333/219

(58) Field of Classification Search
USPC ..... 333/204, 205, 219, 235
See application file for complete search history.

(56) References Cited

U.S. PATENT DOCUMENTS

| | | | | |
|---|---|---|---|---|
| 5,519,366 | A * | 5/1996 | Kaneko et al. | 333/204 |
| 7,629,867 | B2 * | 12/2009 | Tsujiguchi et al. | 333/203 |
| 2008/0143458 | A1 * | 6/2008 | Tsujiguchi et al. | 333/202 |
| 2010/0244990 | A1 * | 9/2010 | Mori et al. | 333/204 |

FOREIGN PATENT DOCUMENTS

| | | | | |
|---|---|---|---|---|
| JP | 8-056106 | A | 2/1996 | |
| WO | WO-2008-038443 | A1 | 4/2008 | |
| WO | WO2009/090814 | * | 7/2009 | H01P 1/203 |

OTHER PUBLICATIONS

PCT/JP2010/055650 Written Opinion dated Jan. 7, 2010.

* cited by examiner

*Primary Examiner* — Benny Lee
*Assistant Examiner* — Gerald Stevens
(74) *Attorney, Agent, or Firm* — Dickstein Shapiro LLP

(57) ABSTRACT

A stripline filter having a substrate, a grounding electrode, principal-surface lines, side-surface lines, and common electrodes, and is mounted on a set substrate by soldering. The side-surface lines are disposed on a side surface of the substrate, and are wetted by solder during soldering. Each of the common electrodes is connected to a corresponding one of the principal-surface lines. The common electrodes are also connected to the grounding electrode via the side-surface lines.

7 Claims, 6 Drawing Sheets

FIG. 3(A) – PRIOR ART
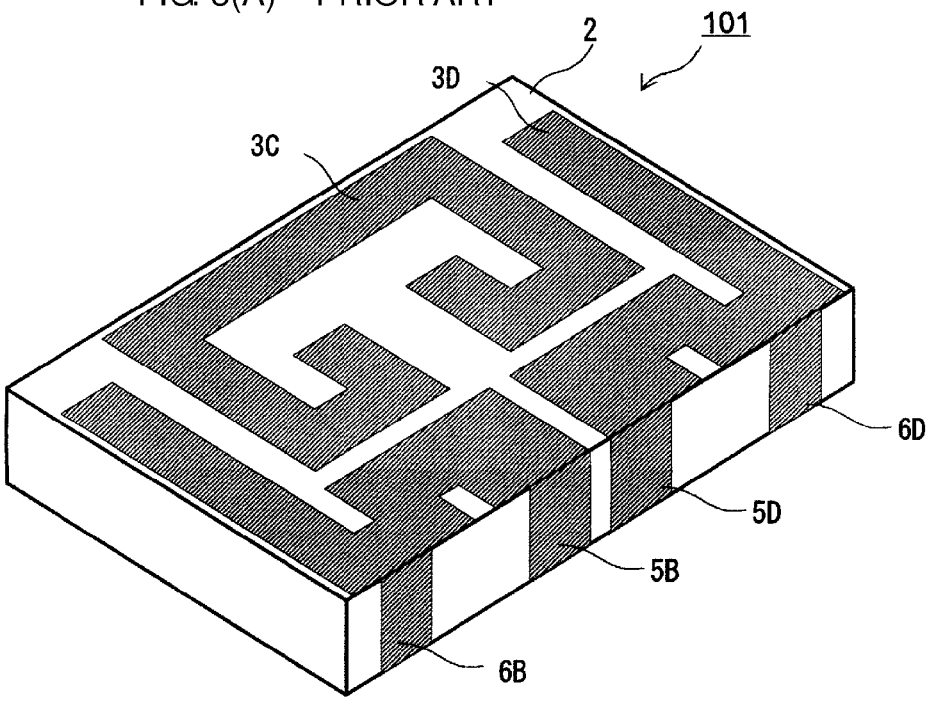
FIG. 3(B) – PRIOR ART
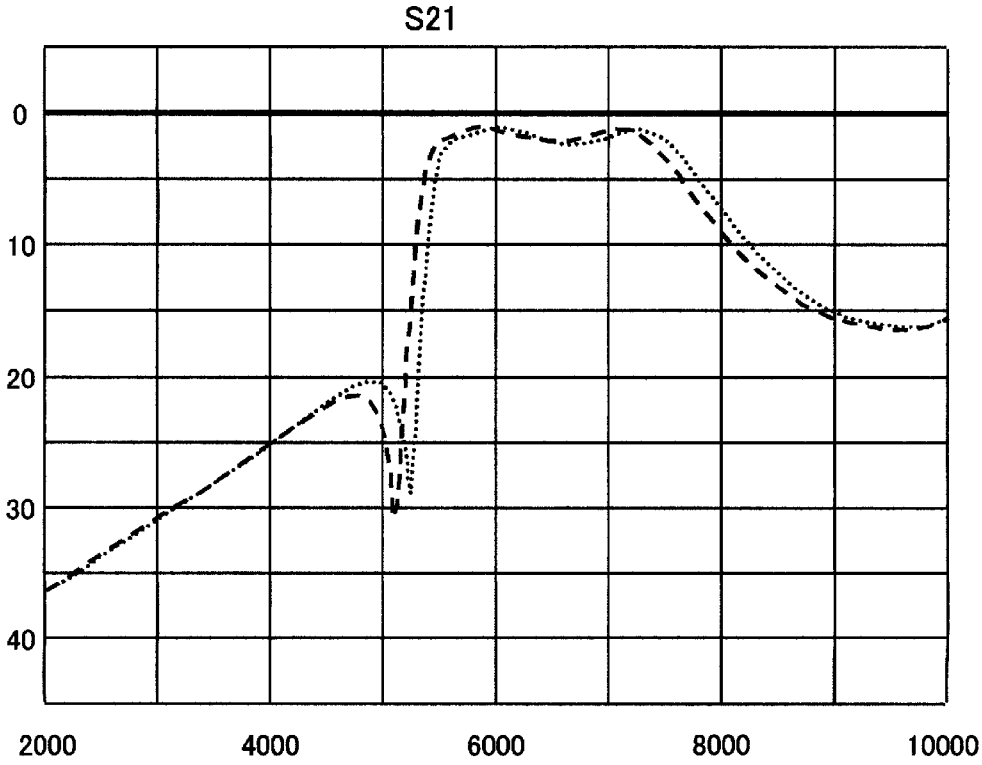

FIG. 4(A) – PRIOR ART
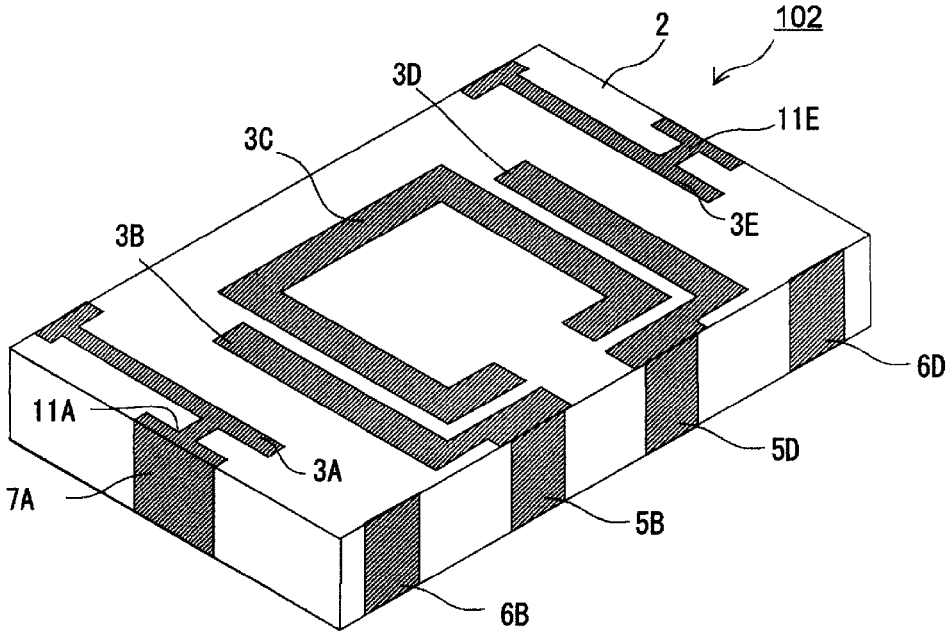
FIG. 4(B) – PRIOR ART
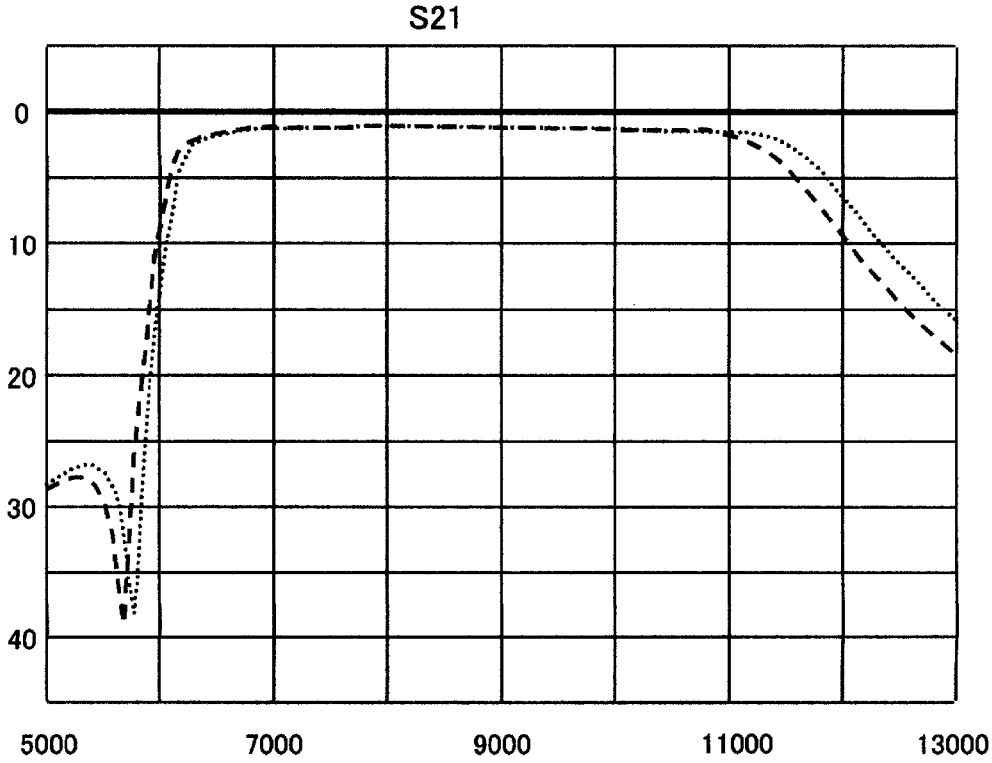

FIG. 5(A) – PRIOR ART
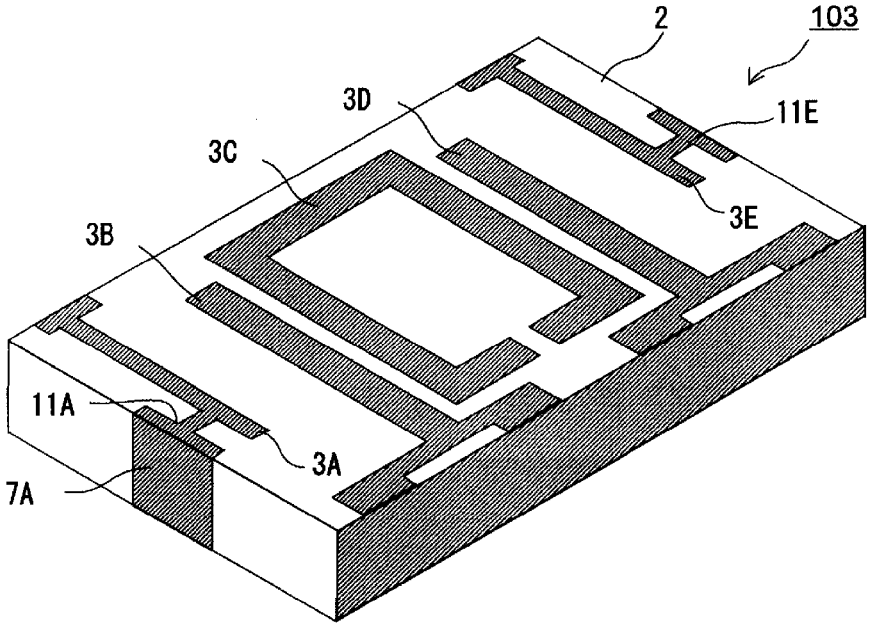
FIG. 5(B) – PRIOR ART
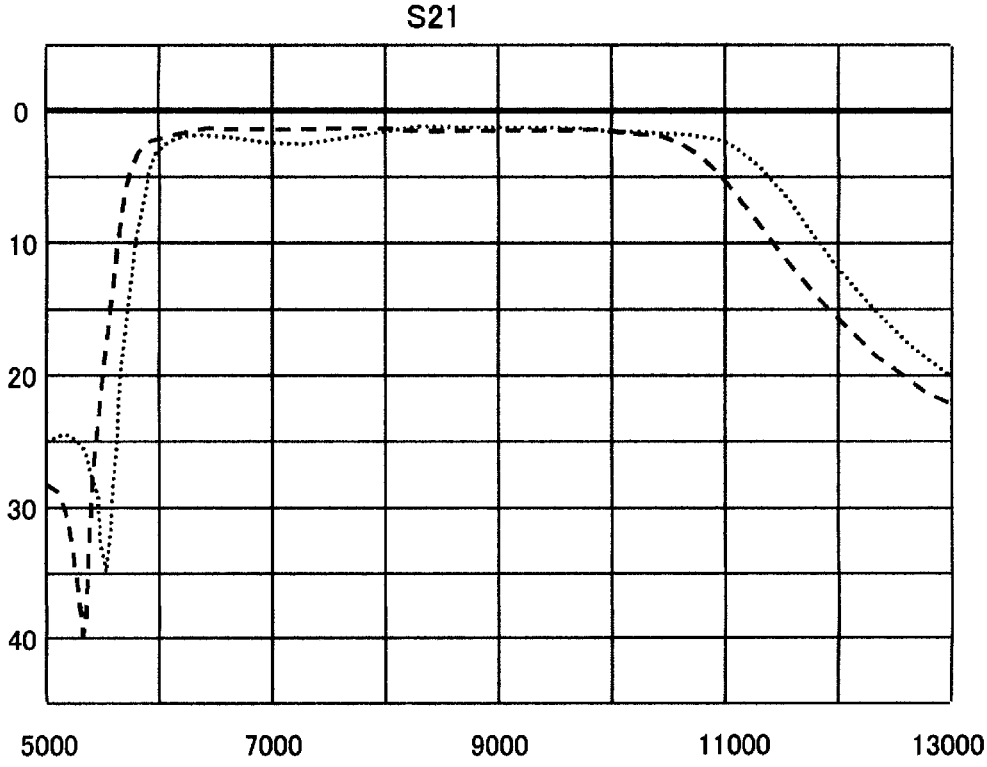

STRIPLINE FILTER

CROSS REFERENCE TO RELATED APPLICATIONS

The present application is a continuation of International application No. PCT/JP2010/055650, filed Mar. 30, 2010, which claims priority to Japanese Patent Application No. 2009-126666, filed May 26, 2009, the entire contents of each of which are incorporated herein by reference.

FIELD OF THE INVENTION

The present invention relates to stripline filters that include stripline resonators formed on a dielectric substrate.

BACKGROUND OF THE INVENTION

Stripline filters include striplines formed on a dielectric substrate. A type of stripline filters includes a dielectric substrate, a grounding electrode, input/output electrodes, principal-surface lines, and side-surface lines (for example, see PTL 1). The grounding electrode and the input/output electrodes are disposed on a land of a set substrate. The principal-surface lines are disposed opposite the grounding electrode. Some of the side-surface lines and the principal-surface lines form resonant lines. In addition, some of the side-surface lines allow tap coupling between the input/output electrodes and the principal-surface lines.

PTL 1: WO2008/038443

SUMMARY OF THE INVENTION

A stripline filter is mounted on a set substrate by means of soldering, and soldering fillets are formed of solder that wets up side-surface lines. The soldering fillets cause impedance in the vicinities of the side-surface lines to vary in accordance with the material amounts and the shapes of the soldering fillets. As a result, the frequency characteristics of the stripline filter vary from those anticipated in design. Thus, variations in the material amounts and the shapes of soldering fillets attached to a single stripline filter lead to variations in the frequency characteristics of the single stripline filter.

An object of the present invention is to provide a stripline filter which can reduce variations in the frequency characteristics of the single stripline filter mounted on a set substrate by means of soldering.

A stripline filter of the present invention includes a dielectric substrate, a grounding electrode, principal-surface lines, an input/output electrode, side-surface lines and a common electrode. The stripline filter is mounted on a set substrate by means of soldering. The grounding electrode is disposed on a bottom surface of the dielectric substrate and is grounded. The principal-surface lines are disposed on a principal surface of the dielectric substrate and form resonators along with the dielectric substrate and the grounding electrode. The input/output electrode is disposed on the bottom surface of the dielectric substrate and is coupled to any of the resonators. The side-surface lines are disposed on side surfaces of the dielectric substrate and are wetted up by solder by means of the soldering. The common electrode is disposed on the dielectric substrate, and is connected to the principal-surface lines and connected to the grounding electrode via the side-surface lines, which are provided in a greater number than the principal-surface lines.

In the stripline filter having the configuration in which the resonator is connected to the grounding electrode via the side-surface lines which are provided in a greater number than the principal-surface lines, changes in the frequency characteristics of the stripline filter between before and after the mounting by means of soldering can be suppressed. Accordingly, according to the present configuration, even when the material amounts and the shapes of soldering fillets vary in a single stripline filter, variations in the frequency characteristics of the stripline filter can be reduced.

It is preferable that the side-surface lines of the present invention which are connected to the single common electrode be disposed on an identical side surface of the dielectric substrate and have an identical line width.

Accordingly, the material amounts and the shapes of the soldering fillets are not likely to vary, further reducing the variations in frequency characteristics.

It is preferable that at least one of the side-surface lines of the present invention which are connected to the common electrode be adjacent to a side-surface line of another distal-stage resonator that is located beyond another adjacent-stage resonator, and that a space between the adjacent side-surface lines be narrower than a space between a principal-surface line connected to the common electrode and a principal-surface line of the distal-stage resonator.

Accordingly, jump-coupling between the resonator and the distal-stage resonator can be enhanced. Moreover, variations in the intensity of this coupling which are caused by the soldering fillets can be reduced.

It is preferable that the common electrode of the present invention be formed on the principal surface of the dielectric substrate, and that the stripline filter include an insulating layer that is stacked on the principal surface of the dielectric substrate and covers the principal-surface lines and the common electrode.

The insulating layer covers the common electrode and the principal-surface lines which intersect or bend at electrode edges having, for example, inner corners or outer corners, thereby preventing peeling of the electrodes at such edges. In addition, the common electrode and the principal-surface lines are prevented from being wetted up by solder, further reducing the variations in frequency characteristics.

It is preferable that the principal-surface lines and the common electrode of the present invention be composed of a photosensitive electrode material, and that the side-surface lines, the grounding electrode, and the input/output electrode be composed of a non-photosensitive electrode material.

Accordingly, the electrode thickness of the side-surface lines is larger than that of the principal-surface lines and the common electrode, and it is not likely that a break will occur in the side-surface lines due to peeling of the electrodes at edges of the side-surface lines.

According to the present invention, a single resonator is grounded with multiple side-surface lines, thereby reducing variations in the frequency characteristics of a stripline filter between before and after mounting by means of soldering. Furthermore, even when the material amounts and the shapes of soldering fillets of the stripline filter vary, variations in the frequency characteristics of the single stripline filter can be reduced.

BRIEF DESCRIPTION OF THE DRAWINGS

FIGS. 3(A) and 3(B) include diagrams explaining a prior art stripline filter having a first comparative configuration.

FIGS. 4(A) and 4(B) include diagrams explaining a prior art stripline filter having a second comparative configuration.

FIGS. 5(A) and 5(B) include diagrams explaining a prior art stripline filter having a third comparative configuration.

DETAILED DESCRIPTION OF THE INVENTION

First Embodiment

A stripline filter according to a first embodiment of the present invention will be described below, taking a band pass filter 1 as an example. The filter 1 is used for ultra wide band (UWB) communication that uses a high-frequency band of 6 GHz or more.

Figure 1A:
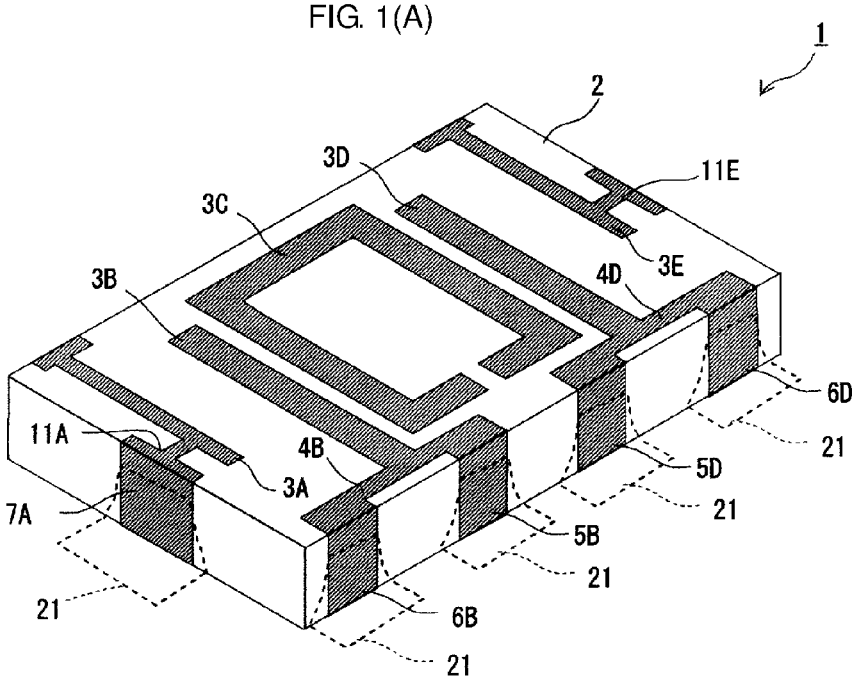
FIGS. 1(A) and 1(B) include perspective views illustrating a stripline filter according to a first embodiment of the present invention.
Figure 1B:
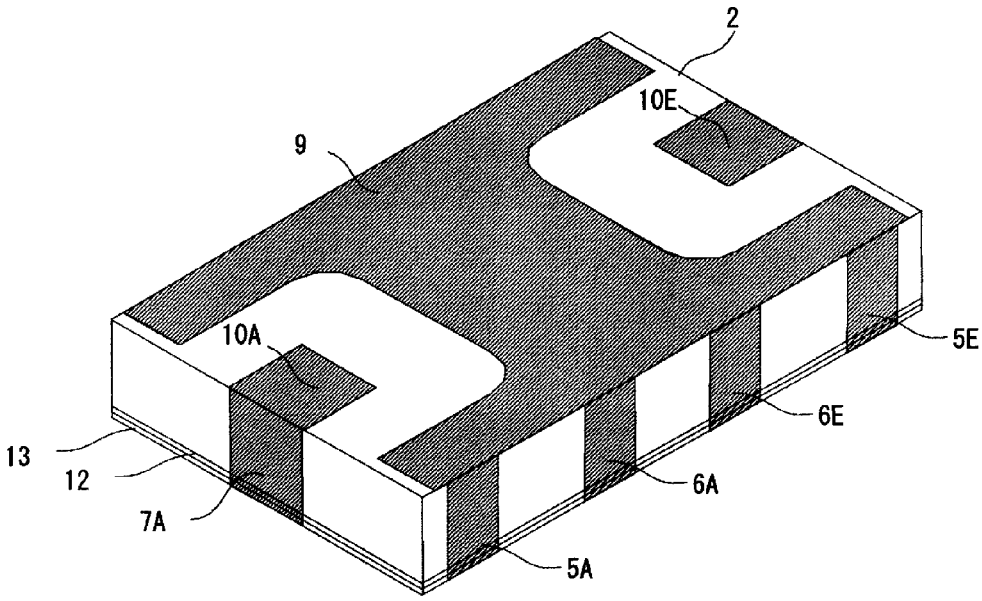

FIG. 1(A) is a perspective view illustrating the filter 1 viewed from the principal-surface side of the filter 1, some portions of which are viewed transparently. FIG. 1(B) is a perspective view illustrating the filter 1 viewed from the bottom surface side of the filter 1.

The filter 1 includes a substrate 2, principal-surface lines 3A to 3E, common electrodes 4B and 4D, side-surface lines 5A, 5B, 5D, 5E, 6A, 6B, 6D, 6E, 7A, and 7E (not illustrated), a grounding electrode 9, input/output electrodes 10A and 10E, lead electrodes 11A and 11E, and glass layers 12 and 13.

The substrate 2 is a small ceramic sintered dielectric substrate that has a rectangular parallelepiped shape, is composed of titanium oxide, for example, and has a relative dielectric constant of approximately 111. The composition and dimensions of the substrate 2 are determined with consideration of the frequency characteristics and the specifications of the substrate 2, for example.

The input/output electrode 10A, which has a rectangular shape, is disposed on the bottom surface of the substrate 2 and is in contact with a boundary between the front surface and the bottom surface of the substrate 2. The input/output electrode 10E, which has a rectangular shape, is disposed on the bottom surface of the substrate 2 and is in contact with a boundary between the rear surface and the bottom surface of the substrate 2. The grounding electrode 9 is disposed over substantially the entirety of the bottom surface of the substrate 2 except for an edge on the front-surface side of the substrate 2, an edge on the rear-surface side of the substrate 2, and regions around the input/output electrodes 10A and 10E.

The side-surface line 7A, which has the shape of a straight line extending perpendicularly from the principal surface to the bottom surface of the substrate 2, is electrically coupled to the input/output electrode 10A. The side-surface line 7A is disposed along the central axis of the front surface of the substrate 2. The side-surface line 7E (not illustrated), which has the shape of a straight line extending perpendicularly from the principal surface to the bottom surface of the substrate 2, is electrically coupled to the input/output electrode 10E. The side-surface line 7E is disposed along the central axis of the rear surface (not illustrated) of the substrate 2. The side-surface lines 5B, 5D, 6B, and 6D, each of which has the shape of a straight line extending perpendicularly from the principal surface to the bottom surface of the substrate 2, are electrically coupled to the grounding electrode 9. These side-surface lines are arranged on the right-side surface of the substrate 2 in the order of the side-surface lines 6B, 5B, 5D, and 6D, with the side-surface line 6B disposed on the front-surface side of the substrate 2 and with the side-surface line 6D disposed on the rear-surface side of the substrate 2. The side-surface lines 5A, 5E, 6A, and 6E, each of which has the shape of a straight line extending perpendicularly from the principal surface to the bottom surface of the substrate 2, are electrically coupled to the grounding electrode 9. These side-surface lines are arranged on the left-side surface of the substrate 2 in the order of the side-surface lines 5A, 6A, 6E, and 5E, with the side-surface line 5A disposed on the front-surface side of the substrate 2 and with the side-surface line 5E disposed on the rear-surface side of the substrate 2.

The group of electrodes disposed on the right-side surface of the substrate 2 and the group of electrodes on the left-side surface of the substrate 2 are formed using respective electrode patterns that have point symmetry and congruency with each other. Such formation enables the electrodes on the right-side surface and those on the left-side surface to be formed in the same way. Similarly, the electrode disposed on the front surface of the substrate 2 and the electrode disposed on the rear surface of the substrate 2 are formed using respective electrode patterns that have point symmetry and congruency with each other. Such formation enables the electrode on the front surface and that on the rear surface to be formed in the same way. By arranging the electrodes with point symmetry and congruency, the mounting position of the filter 1 will be appropriate as a result of self alignment effects caused by soldering when the filter 1 is mounted. The side-surface lines 6A and 6E are not necessary in terms of the electrical configuration. However, these side-surface lines are disposed so that the electrode patterns that are used for the side surfaces opposing each other are made congruent.

The above-described electrodes disposed on the bottom surface and the side surfaces of the substrate 2 have an electrode thickness of approximately 12 μm or more. These electrodes are formed by applying a non-photosensitive silver paste to the substrate 2 with a screen mask or a metal mask, and then firing the substrate 2.

When the filter 1 is mounted on a set substrate by means of soldering, the input/output electrodes 10A and 10E are placed on a soldering paste applied to lands that are to be input/output terminals on the set substrate. The grounding electrode 9 is placed on a soldering paste applied to a land that is to be a grounding terminal on the set substrate. The soldering paste is melted by being heated, and the molten soldering paste wets up the side-surface lines, forming soldering fillets 21.

The principal-surface line 3A is constituted by a rectangular portion having a large width, and a straight line portion. The rectangular portion is located so as to be in contact with the left-side surface of the substrate 2 and is electrically coupled to the side-surface line 5A. The straight line portion extends from the rectangular portion perpendicularly with respect to the left-side surface and the right-side surface of the substrate 2. The principal-surface line 3A is disposed on the principal surface of the substrate 2 with one end of the straight line portion being spaced apart from the boundary between the right-side surface and the principal surface of the substrate 2. The principal-surface line 3E is constituted by a rectangular portion having a large width, and a straight line portion. The rectangular portion is located so as to be in contact with the left-side surface of the substrate 2 and is electrically coupled to the side-surface line 5E. The straight line portion extends from the rectangular portion perpendicularly with respect to the left-side surface and the right-side surface of the substrate 2. The principal-surface line 3E is disposed on the principal surface of the substrate 2 with one end of the straight line portion being spaced apart from the boundary between the right-side surface and the principal surface of the substrate 2. The principal-surface line 3C is a rectangular loop-shaped electrode having an opening on the right-side surface side of the substrate 2, and forms a C-shaped line. The principal-surface line 3C is disposed in a central portion of the principal surface of the substrate 2, and the entire principal-surface line 3C is spaced apart from the boundaries of the principal surface of the substrate 2.

The lead electrode 11A is constituted by a rectangular portion having a large width, and a straight line portion. The rectangular portion is located so as to be in contact with the front-side surface of the substrate 2 and is electrically coupled to the side-surface line 7A. The straight line portion extends from the rectangular portion perpendicularly with respect to the front-side surface and the rear-side surface of the substrate 2. The lead electrode 11A is disposed on the principal surface of the substrate 2 with one end of the straight line portion being electrically coupled to the side of the principal-surface line 3A. The lead electrode 11E is constituted by a rectangular portion having a large width, and a straight line portion. The rectangular portion is located so as to be in contact with the rear-side surface of the substrate 2 and is electrically coupled to the side-surface line 7E. The straight line portion extends from the rectangular portion perpendicularly with respect to the front-side surface and the rear-side surface of the substrate 2. The lead electrode 11E is disposed on the principal surface of the substrate 2 with one end of the straight line portion being electrically coupled to the side of the principal-surface line 3E.

The common electrode 4B is constituted by a straight line portion and rectangular portions, and is disposed on the principal surface of the substrate 2. The straight line portion extends parallel to the right-side surface of the substrate 2. Each rectangular portion extends from a corresponding end of the straight line portion, extends perpendicularly to the right-side surface side of the substrate 2 to form a bending portion of the common electrode 4B, and is electrically coupled to a corresponding side-surface line 5B or 6B. The principal-surface line 3B is a straight line portion extending from an approximately central portion of the straight line portion of the common electrode 4B and extending perpendicularly with respect to the left-side surface and the right-side surface of the substrate 2. The principal-surface line 3B is disposed on the principal surface of the substrate 2 with one end of the principal-surface line 3B being spaced apart from the boundary between the principal surface and the left-side surface of the substrate 2.

The common electrode 4D is constituted by a straight line portion and rectangular portions, and is disposed on the principal surface of the substrate 2. The straight line portion extends parallel to the right-side surface of the substrate 2. Each rectangular portion extends from a corresponding end of the straight line portion, extends perpendicularly to the right-side surface side of the substrate 2 to form a bending portion of the common electrode 4D, and is electrically coupled to a corresponding side-surface line 5D or 6D. The principal-surface line 3D is a straight line portion extending from an approximately central portion of the straight line of the common electrode 4D and extending perpendicularly with respect to the left-side surface and the right-side surface of the substrate 2. The principal-surface line 3D is disposed on the principal surface of the substrate 2 with one end of the principal-surface line 3D being spaced apart from the boundary between the principal surface and the left-side surface of the substrate 2.

These electrodes disposed on the principal surface of the substrate 2, which have an electrode thickness of approximately 5 μm or more, are formed by applying a photosensitive silver paste to the substrate 2, forming a pattern on the substrate 2 by a photolithography process, and then firing the substrate 2. As a result, the substrate 2 has an electrode shape of high precision.

The glass layer 12 is composed of light-transmissive glass, having a thickness of approximately 15 μm and being stacked on the principal surface of the substrate 2. The glass layer 13 is composed of light-blocking glass, having a thickness of approximately 15 μm and being stacked on the principal surface of the glass layer 12. The glass layers 12 and 13 correspond to insulating layers of the present invention, and prevent peeling of the principal-surface lines and the common electrodes formed on the principal surface of the substrate 2, contributing to mechanical protection and enhancement of environmental resistance, for example. The glass layers 12 and 13 are not necessary components, and a configuration may be employed in which the glass layers 12 and 13 are not formed and the principal surface of the substrate 2 is exposed. Instead, another configuration may be employed in which a second dielectric substrate is stacked on the principal surface of the substrate 2 and the principal surface of the second substrate also has a grounding electrode. The electrodes formed on the side surfaces and the bottom surface of the dielectric substrate 2 are thicker than those formed on the principal surface of the dielectric substrate 2, thereby preventing peeling of the electrodes formed on the side surfaces and the bottom surface which are not covered with the glass layers 12 and 13.

According to the above-described configuration of the filter 1, the principal-surface line 3A and the side-surface line 5A serve as a resonant line which opposes the grounding electrode 9 with the substrate 2 interposed between the resonant line and the grounding electrode 9, whereby an input-stage (or output-stage) quarter wavelength resonator is formed. The principal-surface line 3B, the common electrode 4B, the side-surface line 5B, and the side-surface line 6B serve as a resonant line which opposes the grounding electrode 9 with the substrate 2 interposed between the resonant line and the grounding electrode 9, whereby a second-stage quarter wavelength resonator is formed. The principal-surface line 3C serves as a resonant line which opposes the grounding electrode 9 with the substrate 2 interposed between the resonant line and the grounding electrode 9, whereby a third-stage half wavelength resonator is formed. The principal-surface line 3D, the common electrode 4D, the side-surface line 5D, and the side-surface line 6D serve as a resonant line which opposes the grounding electrode 9 with the substrate 2 interposed between the resonant line and the grounding electrode 9, whereby a fourth-stage quarter wavelength resonator is formed. The principal-surface line 3E and the side-surface line 5E serve as a resonant line which opposes the grounding electrode 9 with the substrate 2 interposed between the resonant line and the grounding electrode 9, whereby an output-stage (or input-stage) quarter wavelength resonator is formed. The lead electrode 11A and the side-surface line 7A serve as a tap electrode, coupling the input-stage (or output-stage) quarter wavelength resonator to the input/output electrode 10A. The lead electrode 11E and the side-surface line 7E (not illustrated) serve as a tap electrode, coupling the output-stage (or input-stage) quarter wavelength resonator to the input/output electrode 10E.

According to the above configuration, the filter 1 is constituted by five stages of resonators that are coupled to each other by interdigital coupling, whereby a wide-band band pass filter is formed which is applicable to UWB communication, for example. Each of the second-stage and fourth-stage quarter wavelength resonators has a principal-surface line on the open end side thereof and multiple side-surface lines on the short-circuit end side thereof. Therefore, when the filter 1 is mounted on a set substrate by means of soldering, this configuration reduces the adverse effect on the frequency characteristics which is caused by the soldering fillets 21.

If the side-surface lines 5B and 6B are formed on different side surfaces of the dielectric substrate 2 or have different line widths, soldering fillets 21 corresponding to these side-surface lines are likely to have different shapes and amounts. However, by forming these side-surface lines on the same side surface of the dielectric substrate, the soldering fillets 21 corresponding to these side-surface lines are likely to have similar shapes and amounts. Moreover, the frequency characteristics of the resonator act so that the adverse effects caused by variations among the shapes and the material amounts of the soldering fillets 21 corresponding to these two side-surface lines are evened out, and are thus easily stabilized. The side-surface lines 5D and 6D also have a similar effect.

In addition, the side-surface line 5B included in the second-stage resonator is adjacent to the side-surface line 5D included in the fourth-stage resonator, causing a mutual capacitance to be generated between these two electrodes. This mutual capacitance causes jump-coupling to occur between the second-stage and fourth-stage resonators. In the present invention, since the adverse effect caused by variations in solder that wets up the side-surface lines can be reduced, variations in the jump-coupling in a single stripline filter can also be reduced.

Hereinafter, examples of how frequency characteristics of comparative configurations vary compared with those of the configuration of the present invention (present configuration) will be shown, and the advantages of the present invention will be described.

Figure 2:
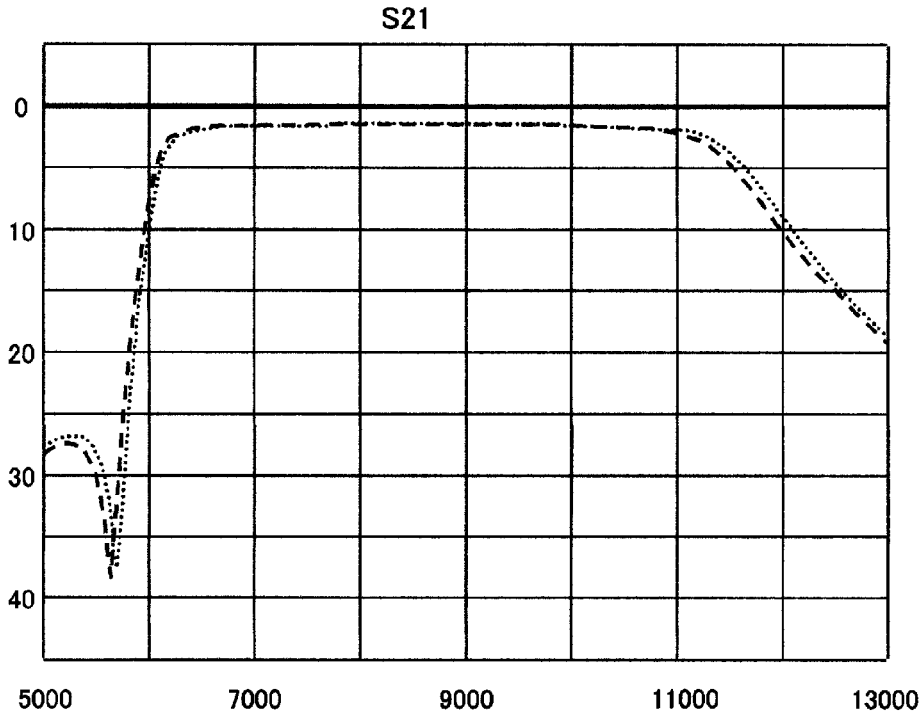
FIG. 2 is a graph showing frequency characteristics of the stripline filter illustrated in FIG. 1.

FIG. 2 is a graph showing exemplary frequency characteristics of the filter 1 according to the embodiment of the present invention. The broken line in FIG. 2 represents frequency characteristics before the mounting by means of soldering. The dotted line in FIG. 2 represents frequency characteristics after the mounting by means of soldering.

The frequency characteristics were measured under the following shape settings.

- The line width of the principal-surface lines 3A and 3E: 60 μm
- The line width of the principal-surface lines 3B to 3D: 120 μm
- The line width of the side-surface lines 5A, 5B, 5D, 5E, 6B, and 6D: 200 μm
- The spacing between the side-surface lines 5B and 6B (5D and 6D): 300 μm
- The spacing between the side-surface lines 5B and 5D: 350 μm
- The line width of the side-surface lines 7A and 7B: 300 μm
- The bottom width of the soldering fillets: 250 μm
- The height of the soldering fillets: 350 μm The filter 1 of the present configuration had a center frequency $f_0$ of approximately 8767 MHz before the mounting by means of soldering, and a center frequency $f_0'$ of approximately 8846 MHz after the mounting by means of soldering. That is, the center frequency $f_0'$ after the mounting by means of soldering had changed by 0.91% with respect to the center frequency $f_0$ before the mounting by means of soldering. The band width (3 dBBW) before the mounting by means of soldering was approximately 5344 MHz whereas that after the mounting by means of soldering was approximately 5421 MHz. That is, the band width (3 dBBW) after the mounting by means of soldering had changed by 1.4% with respect to that before the mounting by means of soldering.

FIG. 3(A) is a perspective view illustrating a filter 101 having a first comparative configuration, viewed from the principal surface side of the filter 101, some portions of which are viewed transparently. The side-surface electrodes 6B and 6D are connected to input/output electrodes formed on the bottom surface of the substrate. The side-surface electrodes 5B and 5D are connected to a grounding electrode formed on the bottom surface of the substrate.

The filter 101 is constituted by three stages of resonators that are coupled to each other by interdigital coupling.

FIG. 3(B) is a graph showing exemplary frequency characteristics of the filter 101. The broken line in FIG. 3(B) represents frequency characteristics before the mounting by means of soldering. The dotted line in FIG. 3(B) represents frequency characteristics after the mounting by means of soldering.

The filter 101 having the first comparative configuration had a center frequency $f_0$ of approximately 6465 MHz before the mounting by means of soldering, and a center frequency $f_0'$ of approximately 6597 MHz after the mounting by means of soldering. That is, the center frequency $f_0'$ after the mounting by means of soldering had changed by 2.04% with respect to that before the mounting by means of soldering. The band width (3 dBBW) before the mounting by means of soldering was approximately 2181 MHz whereas that after the mounting by means of soldering was approximately 2244 MHz. That is, the band width (3 dBBW) after the mounting by means of soldering had changed by 2.9% with respect to that before the mounting by means of soldering.

The change in the center frequency of the filter 1 having the above-described present configuration was 0.91% between before and after the mounting by means of soldering, whereas the change in the center frequency of the filter 101 having the comparative configuration was 2.04% between before and after the mounting by means of soldering. The change for the filter 1 was smaller than that for the filter 101. In addition, the change in the band width of the filter 1 having the present configuration was 1.4% between before and after the mounting by means of soldering, whereas the change in the band width of the filter 101 having the comparative configuration was 2.9% between before and after the mounting by means of soldering. The change for the filter 1 was smaller than that for the filter 101.

FIG. 4(A) is a perspective view illustrating a filter 102 having a second comparative configuration, viewed from the principal surface side of the filter 102, some portions of which are viewed transparently. In FIG. 4(A), like reference characters designate components corresponding to those of the filter 1.

The filter 102 employs shape settings different from those of the filter 1 to achieve the same characteristics. In the filter 102, the side-surface line 6B is spaced apart from the principal-surface line 3B, and the side-surface line 6D is spaced apart from the principal-surface line 3D.

FIG. 4(B) is a graph showing exemplary frequency characteristics of the filter 102. The broken line in FIG. 4(B) represents frequency characteristics before the mounting by means of soldering. The dotted line in FIG. 4(B) represents frequency characteristics after the mounting by means of soldering.

The filter 102 having the second comparative configuration had a center frequency $f_0$ of approximately 8790 MHz before the mounting by means of soldering, and a center frequency $f_0'$ of approximately 8971 MHz after the mounting by means of soldering. That is, the center frequency $f_0'$ after the mounting by means of soldering had changed by 2.05% with respect to the center frequency $f_0$ before the mounting by means of soldering. The band width (3 dBBW) before the mounting by means of soldering was approximately 5384 MHz whereas that after the mounting by means of soldering was approximately 5591 MHz. That is, the band width (3 dBBW) after the mounting by means of soldering had changed by 3.8% with respect to that before the mounting by means of soldering.

The change in the center frequency of the filter 1 having the above-described present configuration was 0.91% between before and after the mounting by means of soldering, whereas the change in the center frequency of the filter 102 having the comparative configuration was 2.05% between before and after the mounting by means of soldering. The change for the filter 1 was smaller than that for the filter 102. In addition, the change in the band width of the filter 1 having the present configuration was 1.4% between before and after the mounting by means of soldering, whereas the change in the band width of the filter 102 having the comparative configuration was 3.8% between before and after the mounting by means of soldering. The change for the filter 1 was smaller than that for the filter 102.

The above results show that even if the material amounts and the shapes of the soldering fillets 21 vary in the present configuration, the present configuration reduces the variations in frequency characteristics compared with the above-described comparative configuration.

Hereinafter, effects of the configuration of the present invention (present configuration) will be described compared with a third comparative configuration.

FIG. 5(A) is a perspective view illustrating a filter 103 having the third comparative configuration, viewed from the principal surface side of the filter 103, some portions of which are viewed transparently.

The filter 103 has an exemplary configuration that is different from that of the filter 1 in that solid electrodes are formed over the entireties of the right-side and left-side surfaces of the substrate 2.

FIG. 5(B) is a graph showing exemplary frequency characteristics of the filter 1 having the present configuration and those of the filter 103 having the comparative configuration. These frequency characteristics were measured before the mounting by means of soldering. The broken line in FIG. 5(B) represents frequency characteristics of the present configuration. The dotted line in FIG. 5(B) represents frequency characteristics of the comparative configuration.

The filter 103 having the comparative configuration had a center frequency of approximately 8632 MHz. The filter 1 having the present configuration had a center frequency of approximately 8347 MHz. In other words, the resonant frequency of the present configuration was lower than that of the configuration in which a single solid electrode constitutes each of side-surface electrodes. It can be considered that this is because in the configuration having the solid electrodes, the connecting portions between the common electrodes and the side-surface electrode functioned as grounding ends of the resonators whereas in the present configuration, the vicinities of the connecting portions between the side-surface lines and the grounding electrode functioned as grounding ends. Accordingly, when the same resonant frequency is to be achieved, the present configuration is more appropriate than the comparative configuration for reducing the size of the outer shape of the filter. In this comparative example, the filter 103 having the comparative configuration had a band width (3 dBBW) of approximately 5406 MHz, and the filter 1 having the present configuration had a band width (3 dBBW) of approximately 5153 MHz.

Second Embodiment

A stripline filter according to a second embodiment of the present invention will be described below, taking a filter 51 as an example. In the filter 51, all of the resonators are quarter wavelength resonators, and all of the intermediate stages of the resonators except for the input and output stages have the configuration of the present invention. Hereinafter, like reference characters designate components similar to those according to the first embodiment, and such components will not be described.

Figure 6:
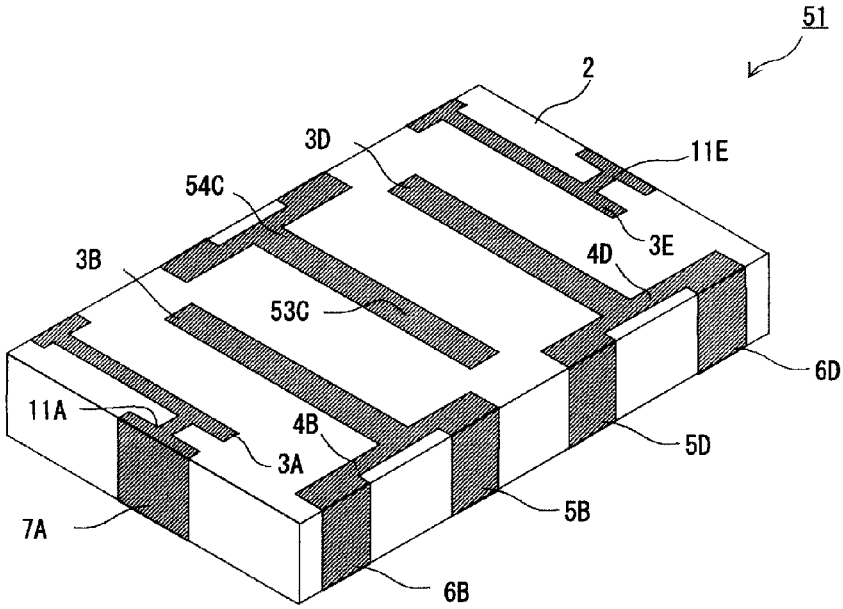
FIG. 6 is a perspective view illustrating a stripline filter according to a second embodiment of the present invention.

FIG. 6 is a perspective view illustrating the filter 51 viewed from the principal-surface side of the filter 51, some portions of which are viewed transparently.

In the filter 51, the third-stage resonator includes a principal-surface line 53C, a common electrode 54C, and the side-surface lines 6A and 6E (not illustrated). The side-surface lines 6A and 6E (not illustrated) are electrically coupled to the common electrode 54C.

The common electrode 54C is constituted by a straight line portion and rectangular portions, and is disposed on the principal surface of the substrate 2. The straight line portion extends parallel to the left-side surface of the substrate 2. Each rectangular portion extends from a corresponding end of the straight line portion, extends perpendicularly to the left-side surface side of the substrate 2 to form a bending portion of the common electrode 54C, and is electrically coupled to a corresponding side-surface line 6A or 6E (not illustrated). The principal-surface line 53C is a straight line portion extending from an approximately central portion of the straight line of the common electrode 54C and extending perpendicularly with respect to the left-side surface and the right-side surface of the substrate 2. The principal-surface line 53C is disposed on the principal surface of the substrate 2 with one end of the principal-surface line 53C being spaced apart from the boundary between the principal surface and the right-side surface of the substrate 2.

According to the above-described configuration of the filter 51, the principal-surface line 53C, the common electrode 54C, and the side-surface lines 6A and 6E serve as a resonant line which opposes the grounding electrode 9 with the substrate 2 interposed between the resonant line and the grounding electrode 9, whereby a third-stage quarter wavelength resonator is formed. Accordingly, the third-stage resonator has a principal-surface line on the open end side thereof and multiple side-surface lines on the short-circuit end side thereof. Therefore, when the filter 51 is mounted on a set substrate by means of soldering, this configuration reduces the adverse effect on the frequency characteristics which is caused by the material amounts and the shapes of the soldering fillets on the side-surface electrodes.

Third Embodiment

A stripline filter according to a third embodiment of the present invention will be described below, taking a filter 61 as an example. In the filter 61, the input and output stages of the resonators also have the configuration of the present invention. Hereinafter, like reference characters designate components similar to those according to the first embodiment, and such components will not be described.

Figure 7:
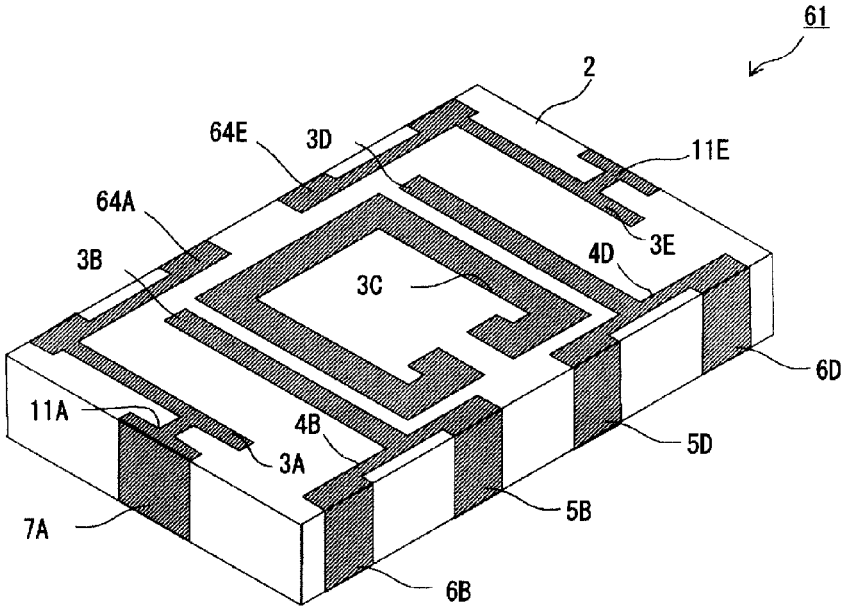
FIG. 7 is a perspective view illustrating a stripline filter according to a third embodiment of the present invention.

FIG. 7 is a perspective view illustrating the filter 61 viewed from the principal-surface side of the filter 61, some portions of which are viewed transparently.

In the filter 61, the input-stage resonator includes the principal-surface line 3A, a common electrode 64A, and the side-surface lines 5A and 6A (not illustrated). The output-stage resonator includes the principal-surface line 3E, a common electrode 64E, and the side-surface lines 5E and 6E (not illustrated). The side-surface line 6A (not illustrated) is electrically coupled to the common electrode 64A, and the side-surface line 6E (not illustrated) is electrically coupled to the common electrode 64E.

The common electrode 64A is constituted by a straight line portion and rectangular portions, and is disposed on the principal surface of the substrate 2. The straight line portion extends parallel to the left-side surface of the substrate 2. Each rectangular portion extends from a corresponding end of the straight line portion, extends perpendicularly to the left-side surface side of the substrate 2 to form a bending portion of the common electrode 64A, and is electrically coupled to a corresponding side-surface line 5A or 6A.

The common electrode 64E is constituted by a straight line portion and rectangular portions, and is disposed on the principal surface of the substrate 2. The straight line portion extends parallel to the left-side surface of the substrate 2. Each rectangular portion extends from a corresponding end of the straight line portion, extends perpendicularly to the left-side surface side of the substrate 2 to form a bending portion of the common electrode 64E, and is electrically coupled to a corresponding side-surface line 5E or 6E.

According to the above-described configuration of the filter 61, the principal-surface line 3A, the common electrode 64A, and the side-surface lines 5A and 6A serve as a resonant line which opposes the grounding electrode 9 with the substrate 2 interposed between the resonant line and the grounding electrode 9, whereby an input-stage quarter wavelength resonator is formed. The principal-surface line 3E, the common electrode 64E, and the side-surface lines 5E and 6E serve as a resonant line which opposes the grounding electrode 9 with the substrate 2 interposed between the resonant line and the grounding electrode 9, whereby an output-stage quarter wavelength resonator is formed. Accordingly, each of the input-stage and output-stage resonators has a principal-surface line on the open end side thereof and multiple side-surface lines on the short-circuit end side thereof. Therefore, when the filter 61 is mounted on a set substrate by means of soldering, this configuration reduces the adverse effect on the frequency characteristics which is caused by the material amounts and the shapes of the soldering fillets on the side-surface electrodes.

The positions and shapes of the principal-surface lines according to the above-described embodiments correspond to a product specification, and any positions and shapes may be employed in accordance with a product specification. The present invention can be applied to any configurations in addition to the above-described configurations, and can employ various filter pattern shapes. In addition, the filter may further include another configuration (high-frequency circuit). It is intended that the scope of the present invention be defined by the scope of claims, not by the above-described embodiments, and that the scope of the present invention include all modifications falling within the scope of claims and within the meaning and the scope of equivalents thereto.

REFERENCE NUMERAL LIST

1, 51, 61 . . . filter
2 . . . substrate
3A to 3E . . . principal-surface line
4B, 4D . . . common electrode
5A, 5B, 5D, 5E, 6A, 6B, 6D, 6E, 7A, 7E . . . side-surface line
9 . . . grounding electrode
10A, 10E . . . input/output electrode
11A, 11E . . . lead electrode
12, 13 . . . glass layer

The invention claimed is:

1. A stripline filter that is to be mounted on a set substrate by means of soldering, the stripline filter comprising:

a dielectric substrate having opposed first and second surfaces, and side surfaces connecting the first and second surfaces;

a grounding electrode on the second surface of the dielectric substrate;

a plurality of principal-surface lines on the first surface of the dielectric substrate, the plurality of principal-surface lines opposing the grounding electrode with the dielectric substrate therebetween so as to form one or more resonators;

an input/output electrode on the second surface of the dielectric substrate, the input/output electrode being coupled to any of the one or more resonators;

a plurality of side-surface lines on the side surfaces of the dielectric substrate, the plurality of side-surface lines configured to be wetted by solder when soldered; and a common electrode on the dielectric substrate, the common electrode connected to a single principal-surface line of the plurality of principal-surface lines and connected to the grounding electrode via at least one of the plurality of side-surface lines, the plurality of side-surface lines being provided in a greater number than the plurality of principal-surface lines.

2. The stripline filter according to claim 1, wherein the plurality of principal-surface lines and the common electrode are composed of a photosensitive electrode material, and the plurality of side-surface lines, the grounding electrode, and the input/output electrode are composed of a non-photosensitive electrode material.

3. The stripline filter according to claim 1, wherein the common electrode is connected to the grounding electrode via at least two of the plurality of side-surface lines, wherein the at least two of the plurality of side-surface lines are located on an identical one of said side surfaces of the dielectric substrate and have a substantially identical line width.

4. The stripline filter according to claim 1, wherein the at least one of the plurality of side-surface lines that are connected to the common electrode is adjacent to a side-surface line of another one of the plurality of principle surface lines, and a first space between the adjacent side-surface lines is narrower than a second space between the single principal-surface line connected to the common electrode and a principal-surface line of the another resonator.

5. The stripline filter according to claim 1, wherein the common electrode is located on the first surface of the dielectric substrate.

6. The stripline filter according to claim 5, further comprising an insulating layer adjacent the first surface of the dielectric substrate, the insulating layer covering the plurality of principal-surface lines and the common electrode.

7. The stripline filter according to claim 1, further comprising at least one insulating layer covering the first surface of the dielectric substrate.

* * * * *